US012404688B2

(12) United States Patent
Ginestet

(10) Patent No.: US 12,404,688 B2
(45) Date of Patent: Sep. 2, 2025

(54) RETURN CHANNEL FOR A SURF POOL

(71) Applicant: WHITEWATER WEST INDUSTRIES LTD., Richmond (CA)

(72) Inventor: Clement Ginestet, Saint Quen (FR)

(73) Assignee: WHITEWATER WEST INDUSTRIES LTD., Richmond (CA)

( * ) Notice: Subject to any disclaimer, the term of this patent is extended or adjusted under 35 U.S.C. 154(b) by 0 days.

(21) Appl. No.: 18/654,442

(22) Filed: May 3, 2024

(65) Prior Publication Data

US 2024/0279947 A1 Aug. 22, 2024

Related U.S. Application Data

(63) Continuation-in-part of application No. 18/057,150, filed as application No. PCT/CA2021/000045 on May 18, 2021.

(60) Provisional application No. 63/026,508, filed on May 18, 2020.

(51) Int. Cl.
*E04H 4/00* (2006.01)
*A63B 69/00* (2006.01)

(52) U.S. Cl.
CPC ..... *E04H 4/0006* (2013.01); *A63B 69/0093* (2013.01)

(58) Field of Classification Search
CPC ..... E04H 4/0006; E04H 4/00; A63B 69/0093; A63B 69/125; B63B 34/70
USPC ..... 4/488, 491, 506
See application file for complete search history.

(56) References Cited

U.S. PATENT DOCUMENTS 4,522,535 A * 6/1985 Bastenhof ..... E04H 4/0006 4/491
4,792,260 A 12/1988 Sauerbier
4,905,987 A * 3/1990 Frenzi ..... A63G 31/007 472/117
4,954,014 A 9/1990 Sauerbier et al.
5,171,101 A 12/1992 Sauerbier et al.
5,186,578 A 2/1993 Perslow
6,241,422 B1 6/2001 Makowski
6,460,201 B1 10/2002 Lochtefeld
(Continued)

FOREIGN PATENT DOCUMENTS

CN 102307507 A 1/2012
CN 105683461 A 6/2016
(Continued)

OTHER PUBLICATIONS

WO2018188740A1 Machine Translation (Year: 2024).*
(Continued)

*Primary Examiner* — David P Angwin
*Assistant Examiner* — William R Klotz
(74) *Attorney, Agent, or Firm* — Buchalter, a Professional Corporation

(57) ABSTRACT

A return channel collects and redirects water back into a surf basin of a surf pool attraction. The return channel can be covered by grating panels that improve navigability of the surf pool attraction while still allowing water to be collected in the return channel. The return channel can include a peripheral channel portion that extends around a periphery of one side of the surf pool and a central channel portion that connects to and extends from the peripheral channel portion toward a central region of the surf basin.

23 Claims, 8 Drawing Sheets

(56) References Cited

U.S. PATENT DOCUMENTS

| | | | | |
|---|---|---|---|---|
| 6,912,738 | B2 | 7/2005 | Black | |
| 7,537,414 | B1 | 5/2009 | Raike | |
| 8,303,213 | B2 * | 11/2012 | McFarland | A63G 31/007 405/79 |
| 8,434,966 | B1 | 5/2013 | McFarland | |
| 8,496,403 | B2 * | 7/2013 | Lochtefeld | E04H 4/0006 4/491 |
| 8,561,221 | B2 | 10/2013 | Lochtefeld et al. | |
| 9,103,133 | B2 | 8/2015 | McFarland | |
| 9,279,263 | B2 | 3/2016 | McFarland | |
| 10,145,135 | B2 | 12/2018 | McFarland et al. | |
| 10,280,640 | B2 | 5/2019 | McFarland et al. | |
| 10,364,584 | B2 | 7/2019 | Odriozola Sagastume | |
| 10,449,433 | B1 | 10/2019 | Bennett | |
| 10,526,806 | B2 | 1/2020 | McFarland | |
| 10,851,554 | B1 | 12/2020 | McFarland | |
| RE49,215 | E * | 9/2022 | McFarland | E04H 4/0006 |
| 11,572,702 | B2 | 2/2023 | Lochtefeld | |
| 11,891,834 | B2 | 2/2024 | Ginestet et al. | |
| 2002/0056157 | A1 | 5/2002 | Lochtefeld | |
| 2003/0009821 | A1 * | 1/2003 | Lochtefeld | E04H 4/0006 4/491 |
| 2003/0106146 | A1 | 6/2003 | Black | |
| 2006/0253969 | A1 | 11/2006 | Johnson | |
| 2009/0151064 | A1 * | 6/2009 | Mladick | E04H 4/0006 4/491 |
| 2010/0011497 | A1 * | 1/2010 | Johnson | E04H 4/0006 4/491 |
| 2014/0105685 | A1 * | 4/2014 | McFarland | E04H 4/0006 4/491 |
| 2014/0133914 | A1 | 5/2014 | Lochtefeld et al. | |
| 2015/0089731 | A1 | 4/2015 | Lochtefeld | |
| 2018/0087284 | A1 | 3/2018 | McFarland | |
| 2018/0147469 | A1 | 5/2018 | Bennett et al. | |
| 2018/0209159 | A1 * | 7/2018 | Perslow | A63B 69/0093 |
| 2021/0148129 | A1 * | 5/2021 | Fricano | E04H 4/0006 |
| 2023/0243171 | A1 * | 8/2023 | Lochtefeld | E04H 4/0006 4/491 |
| 2024/0011312 | A1 | 1/2024 | Wynne-Edwards et al. | |
| 2024/0209645 | A1 | 6/2024 | Wynne-Edwards et al. | |
| 2025/0043582 | A1 | 2/2025 | Slater et al. | |

FOREIGN PATENT DOCUMENTS

| | | | | |
|---|---|---|---|---|
| CN | 108601981 | A | 9/2018 | |
| WO | 0064549 | A2 | 11/2000 | |
| WO | 2012150908 | A1 | 11/2012 | |
| WO | WO-2018188740 | A1 * | 10/2018 | A63B 69/0093 |
| WO | 2021159200 | A1 | 8/2021 | |
| WO | 2021232138 | A1 | 11/2021 | |

OTHER PUBLICATIONS

International Search Report and Written Opinion for International Application No. PCT/CA2021/000010, dated Jun. 9, 2021, 11 pages.

International Search Report and Written Opinion for International Application No. PCT/CA2021/000045, dated Aug. 25, 2021, 8 pages.

Supplementary European Search Report for European Application No. 21754167.1, dated Feb. 5, 2024, 8 Pages.

Supplementary European Search Report for European Application No. 21807609.9, dated Jun. 19, 2024, 6 Pages.

Non-Final Office Action for U.S. Appl. No. 18/057,150, dated Aug. 15, 2024, 14 Pages.

Final Office Action for U.S. Appl. No. 18/057,150, dated Dec. 19, 2024, 16 pages.

Applicant-Initiated Interview Summary for U.S. Appl. No. 18/057,150, dated Mar. 11, 2025, 3 pages.

First Office Action for Chinese Application No. 20218049647, dated Feb. 28, 2025, 10 pages.

Final Office Action for U.S. Appl. No. 18/057,150, dated Jun. 17, 2025, 17 pages.

Non-Final Office Action for U.S. Appl. No. 17/932,250, dated Jun. 30, 2025, 18 pages.

Non-Final Office Action for U.S. Appl. No. 18/057,150, dated May 9, 2025, 12 pages.

* cited by examiner

RETURN CHANNEL FOR A SURF POOL

CROSS-REFERENCE TO RELATED APPLICATIONS

This application claims the benefit of, and is a continuation in part of U.S. Non-Provisional patent application Ser. No. 18/057,150. U.S. Non-Provisional patent application Ser. No. 18/057,150 is a national stage entry of PCT Application No. PCT/CA2021/000045, filed May 18, 2021, which claims priority to U.S. Provisional Patent Application No. 63/026,508, filed May 18, 2020, all of which are incorporated by reference in their entirety and for all purposes.

TECHNICAL FIELD

The embodiments discussed in the present disclosure are related to various configurations for a channel configured to return water back into a surf or wave pool.

BACKGROUND

Water parks often include a variety of water related attractions. Surf pools are one of the many water related attractions that can be provided. Surf pools invariably include movement of large volumes of water to create a series of waves configured for surfing enthusiasts. The waves generated often move at least some of the water to a periphery of the surf pool. Extending the size of the surf pool water attractions to collect the water often unnecessarily extends the size of the surf pool attraction, taking up space that can often be used more efficiently for other attractions. For this reason, solutions that allow space to be saved without sacrificing aesthetics or utility of the surf pool are desirable.

The subject matter claimed in the present disclosure is not limited to embodiments that solve any disadvantages or that operate only in environments such as those described above. Rather, this background is only provided to illustrate one example area where some embodiments described in the present disclosure may be practiced.

SUMMARY

Disclosed are various embodiments that relate to managing the movement of large volumes of water and water channel configurations operable to efficiently return water to a surf pool.

A surf pool is described and includes a surf basin; a wave generator disposed on a first side of the surf basin that is configured to generate waves that travel from the first side of the surf basin to a second side of the surf basin opposite the first side of the surf basin; and a return channel extending along at least a portion of a periphery of the second side of the surf basin. In some embodiments, the return channel includes a central channel that extends from the periphery of the second side of the surf basin and into a central portion of the surf basin.

In some embodiments, multiple edge pools can be arranged behind and in close proximity to the return channel. Various configurations are possible including some where the edge pool is either incorporated into the return channel or separated from the return channel by a common wall.

A return channel is described that includes a peripheral channel portion extending along a periphery of a first side of a surf basin; a central channel portion that is connected to and protrudes from the peripheral channel portion and into a central region of the surf basin; and a plurality of grating panels covering the peripheral channel portion and the central channel portion.

Other aspects and advantages of the described embodiments will become apparent from the following detailed description taken in conjunction with the accompanying drawings which illustrate, by way of example, the principles of the described embodiments.

INCORPORATION BY REFERENCE

All publications, patents, and patent applications mentioned in this specification are herein incorporated by reference to the same extent as if each individual publication, patent, or patent application was specifically and individually indicated to be incorporated by reference.

U.S. Pat. No. 11,891,834 issued Feb. 6, 2024 for Chamber and Control System and Method for Generating Waves.

BRIEF DESCRIPTION OF THE DRAWINGS

Example embodiments will be described and explained with additional specificity and detail through the use of the accompanying drawings in which.

DETAILED DESCRIPTION

A surf pool utilizes a device often referred to as a wave generator to create a series of surf waves. Wave generators can be configured to produce a variety of different types of waves with varying sizes and shapes suitable for surfers of various experience and skill level. Accordingly, the surf pool should be operable to provide customizable waves for multiple ability levels.

Figure 1:
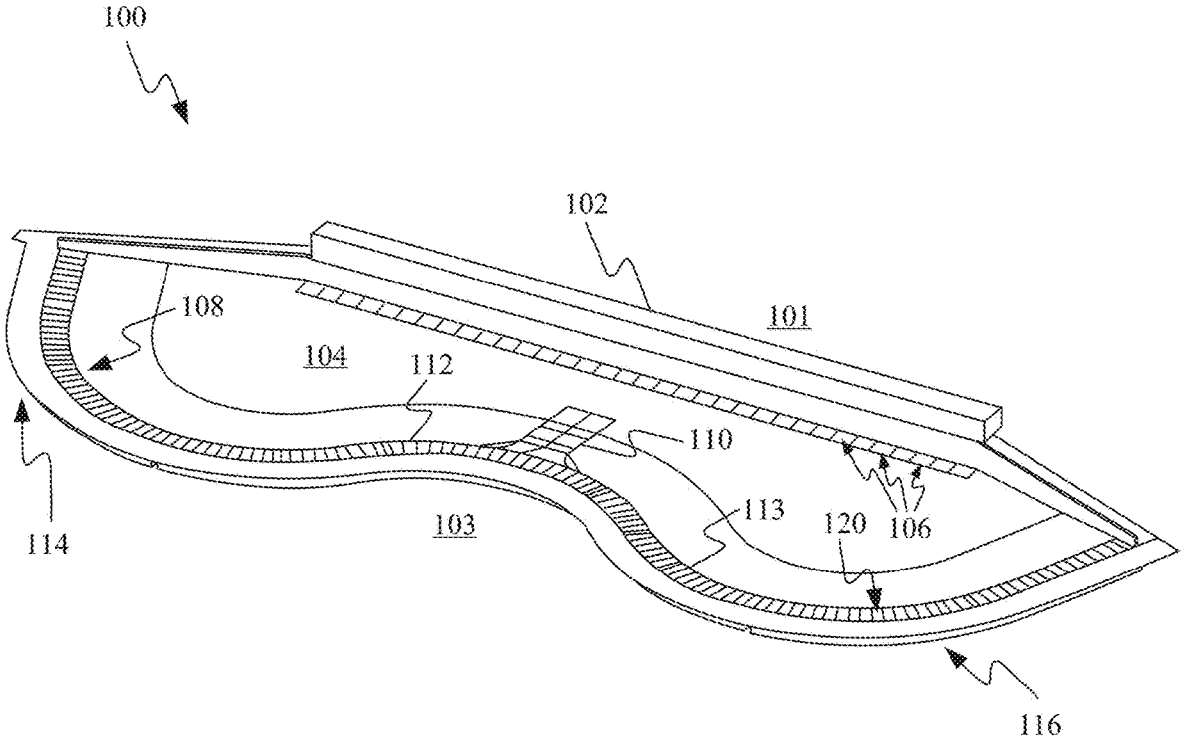
FIG. 1 shows a perspective view of an exemplary surf pool.

FIG. 1 shows an exemplary surf pool 100 in accordance with the disclosure. Surf pool 100 includes a wave generator assembly 102 located on a first side 101 of surf pool 100. The wave generator assembly 102 is operable to generate waves that travel from the first side 101 of surf pool 100 to a second side 103 of surf pool 100. In some embodiments, wave generator assembly 102 can take the form of a pneumatically driven wave generator assembly. When wave generator assembly 102 takes the form of a pneumatically-driven wave generator assembly, the wave generator assembly 102 includes multiple chambers operable to be filled with pressurized air, which in turn periodically pushes water into a surf basin 104 through one or more delivery channels 106 in a manner suitable for generating waves. It should be appreciated that while a specific wave generator assembly 102 is depicted and described, the described embodiments are compatible with a wide variety of wave generator assemblies. For example, FIG. 1 shows a configuration with 34 delivery channels 106. As will be appreciated by those skilled in the art, a larger or smaller number of delivery channels could be used depending on the size of a respective surf pool and an amount of flexibility desired for the types of waves to be generated in the surf pool 100 without departing from the scope of the disclosure. For example, configurations with between 10 and 100 delivery channels are also possible and believed to be within the scope of the described embodiments.

A return channel 108 is positioned at the second side 103 of surf pool 100 and operable to capture portions of the generated waves as they approach a periphery of surf pool 100. The periphery is the edge of the surf pool 100 opposite the delivery channels 106. Return channel 108 can be sized to largely prevent water from inadvertently escaping surf pool 100 during operation of wave generator assembly 102. Once water is captured within return channel 108, the water can be returned into a central portion of surf basin 104. In some embodiments, return channel 108 can be covered by grating panels with an upward facing surface that allows guests or users of the surf pool 100 to conveniently walk over any portion of return channel 108 while still accommodating the passage of water into the return channel 108. Alternatively, guests or users can move over an uncovered portion or portions of return channel 108 using one or more bridges that span return channel 108. Some configurations can include portions of return channel 108 covered by grating panels and other portions remaining uncovered. Bridges or narrow walkways could be operable to allow for passage over any portions of return channel 108 not covered by grating.

A width of return channel 108 can vary. However, widths of between two and six meters allow for large volumes of water to be captured when wave generator assembly 102 is creating its largest waves. The width of return channel depicted in FIG. 1 is about four meters and its depth fixed at about 1.5 meters in one particular embodiment. As will be appreciated by those skilled in the art, the depth of the channel 108 can be greater or less than 1.5 meters and can vary in depth along the length of the channel. For example, in one embodiment a depth of the channel can gradually increase towards the center to encourage larger volumes of water to return more quickly to the surf basin 104. In another embodiment, the depth of the channel can decrease towards the center to encourage water to move toward the ends of return channel 108 initially.

As depicted, return channel 108 is positionable along all or part of the second side 103 of the surf pool 100 opposite the delivery channels 106. The return channel 108 can be configured to have a first side and a second side with a central channel portion 110 that protrudes into a central region of surf basin 104, a first peripheral channel portion 112 that extends away from the central channel portion 110 in a first direction and a second peripheral channel portion 113 that extends away from the central channel portion 110 in a second direction opposite the first direction. The first and second peripheral channel portions 112 and 113 follow a periphery of the second side 103 of surf pool 100. In some embodiments, one or more areas of sand can be positioned 5-10 m past return channel 108 in order to form a beach where guests can congregate. The beach area can also be operable to soak up water and dissipate the force of any waves that end up extending past return channel 108. This can be helpful in scenarios where a section or sections of return channel 108 are flooded with water.

Water captured in the peripheral channel portions 112 and 113 is able to return to surf basin 104 by way of central channel portion 110. In some embodiments, central channel portion 110 can be omitted and water captured within return channel 108 can be returned into surf basin 104 using one or more water pumps. For example, instead of having the depicted central channel portion 110, one or more large intake pipes could be provided. The intake pipes can then be configured to carry water retained by return channel 108 away for redistribution of the water throughout the surf basin 104 using a series of outlet valves.

Central channel portion 110 can also be covered by the same or a similar grating panels 120 overlaying peripheral channel portions 112 and 113. Covering central channel portion 110 with a grating helps avoid discontinuities in the slope and surface of surf basin 104. However, in addition to providing a consistent surface and an efficient mechanism for returning water into surf basin 104, the grating covering central channel portion 110 by virtue of its hole spacing and position within surf basin 104 is operable to dissipate energy in a central portion of surf basin 104 that reduces eddies and other undesired currents resulting from generation of waves by wave generator 102. Reducing eddies and other undesired currents can be particularly helpful in situations where wave generator 102 is concurrently producing a first set of waves travelling toward a first end 114 of surf pool 100 and a second set of waves travelling toward a second end 116 of surf pool 100. In some embodiments, this can allow wave generator assembly 102 to produce a more consistent set of waves without having to wait as long for the surface of the water within surf basin 104 to calm between sets of waves.

Figure 2:
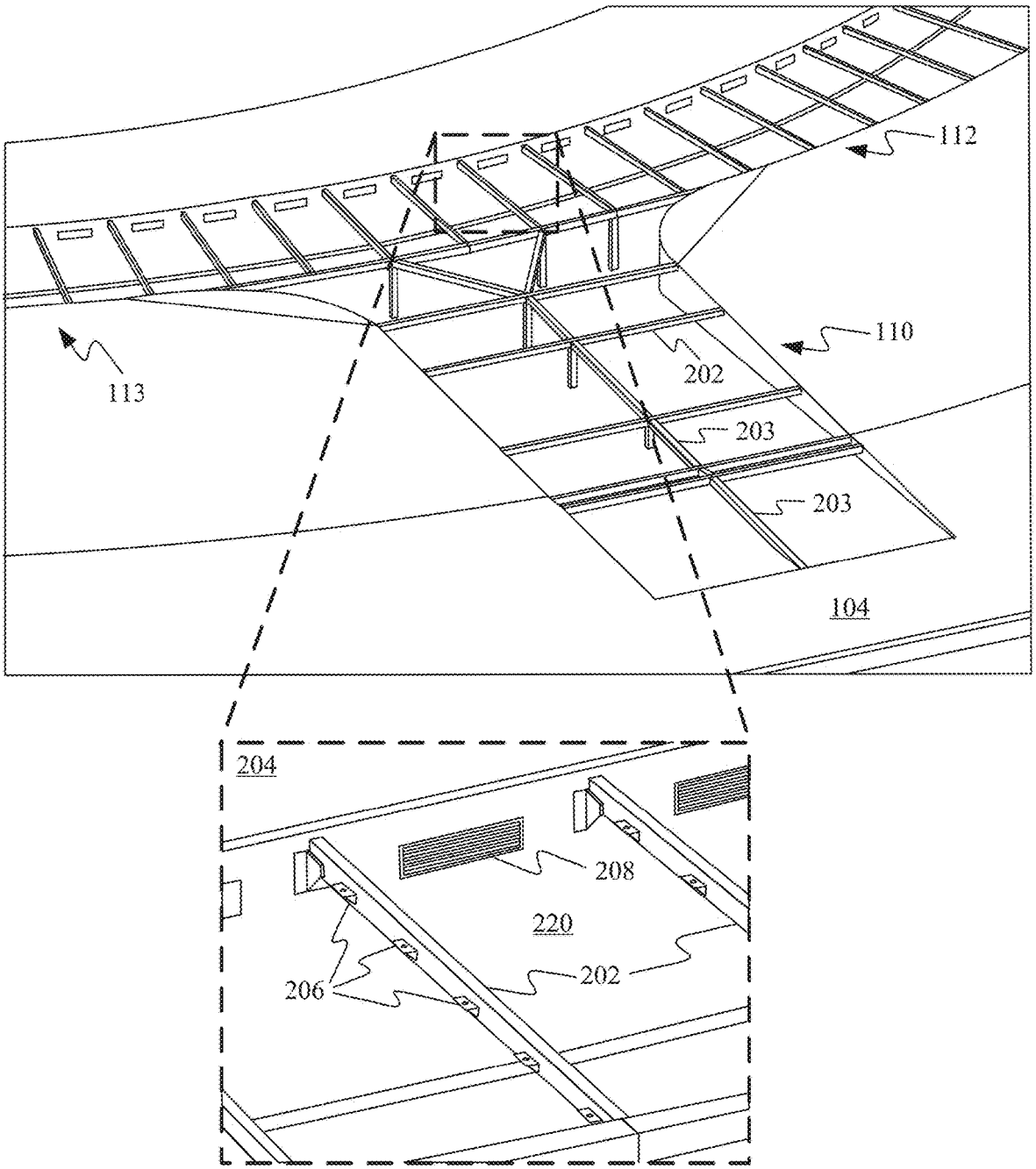
FIG. 2 shows a perspective view of a central region of a return channel of the surf pool depicted in FIG. 1.

FIG. 2 shows a detailed perspective view of the central channel portion 110 and how central channel portion 110 is connected to peripheral channel portions 112 and 113 of return channel 108. Grating panels have been removed from the view shown in FIG. 2 in order to illustrate a configuration of a grating support structure. The grating support structure is operable to support and maintain a position of one or more grating panels over return channel 108. When the grating panel is firmly supported, the grating panel does not change orientation when the weight of a user is applied at any location along the grating panel or when waves impact the grating panels. The grating panels are operable to cover the return channel such that one or more of the plurality of grating panels are in direct contact with the wall shared by the return channel and the edge pool. As depicted, the grating support structure includes multiple beams 202 extending across a width of return channel 108. A space 220 is provided between adjacent beams 202. The space 220 between adjacent beams 202 can be sized to accommodate a grating panel sized to be positioned at a location on the grating support structure so that opposing sides of the grating panel are firmly supported. As depicted, the central channel portion 110 of the return channel 108 is about twice the width of, e.g., first peripheral channel portion 112. In some embodiments, this allows for grating panels used for the peripheral channel portion 112 to be interchangeable with grating panels used for the central channel portion 110. This illustrated configuration is achieved here by arranging one or more central beams 203 within the central channel portion 110 along a centerline of central channel portion 110.

FIG. 2 also includes a close-up view 204 that shows additional detail for some of the beams 202 disposed within peripheral channel portion 112. In some embodiments, beams 202 can take the form of steel beams that include multiple brackets 206 protruding laterally from either side of a respective beam 202 to allow for convenient attachment of the grating panels to beams 202. For example a fastener can be driven through a first fastener opening in a grating panel and then engage a second fastener opening in a bracket 206 to secure the grating panel in place. Close-up view 204 also shows a drain 208 near a top portion of peripheral channel portion 112 that prevents or mitigates situations in which peripheral channel portion 112 overfills due to rain or other circumstances.

Figure 3A:
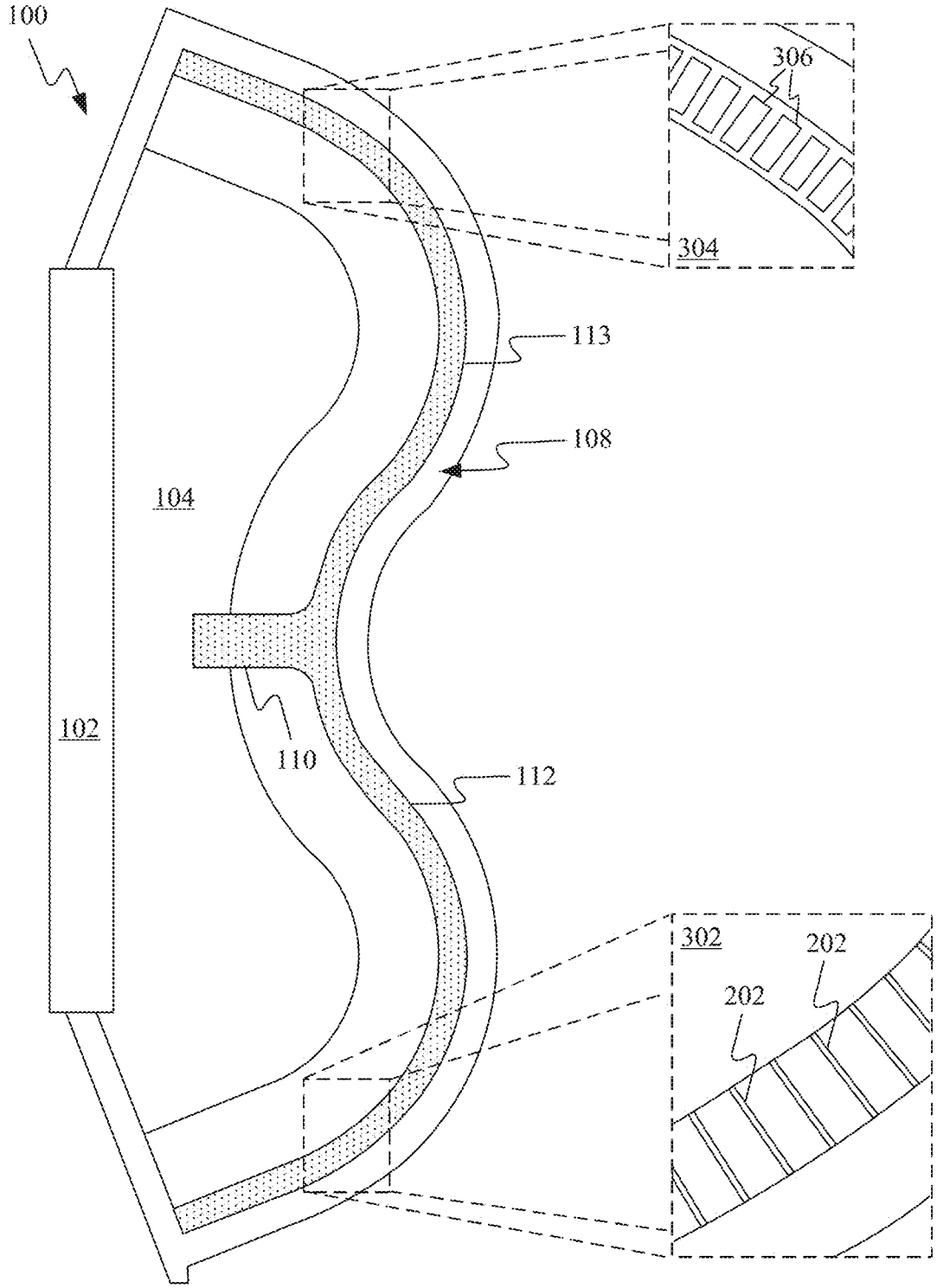
FIG. 3A shows a top-down view of the exemplary surf pool depicted in FIG. 1 with close up views of different portions of the return channel.

FIG. 3A shows a top-down view of surf pool 100 and an overall shape of return channel 108. Return channel 108 is emphasized here using a dot pattern. Central channel portion 110 is shown extending into a central region of surf basin 104. While the serpentine geometry provides a pleasing aesthetic appearance, the concave curvature of the peripheral portion of peripheral channel portion 112 also allows a length of central channel portion 110 to be shorter in length than it would otherwise be in the event return channel had an entirely convex curvature.

Close-up view 302 shows a top view of a configuration in which grating panels are supported by beams 202 as shown in FIG. 2. Close up view 304 shows an alternative support structure configuration for the grating panels using multiple concrete piers 304. Concrete piers 304 can extend from a bottom surface of peripheral channel portion 112 close to a top of peripheral channel portion 112 to support grating panels covering the top of peripheral channel portion 112. In a configuration using concrete piers 304 peripheral channel portion 112 can be slightly deeper to account for space within return channel 108 taken by concrete piers 304. In some embodiments, a mix of beams 202 and concrete piers 306 can be used to support grating panels covering return channel 108. In other embodiments, either beams 202 or concrete piers 306 are used to support grating panels extending over the entirety of return channel 208.

Figure 3B:
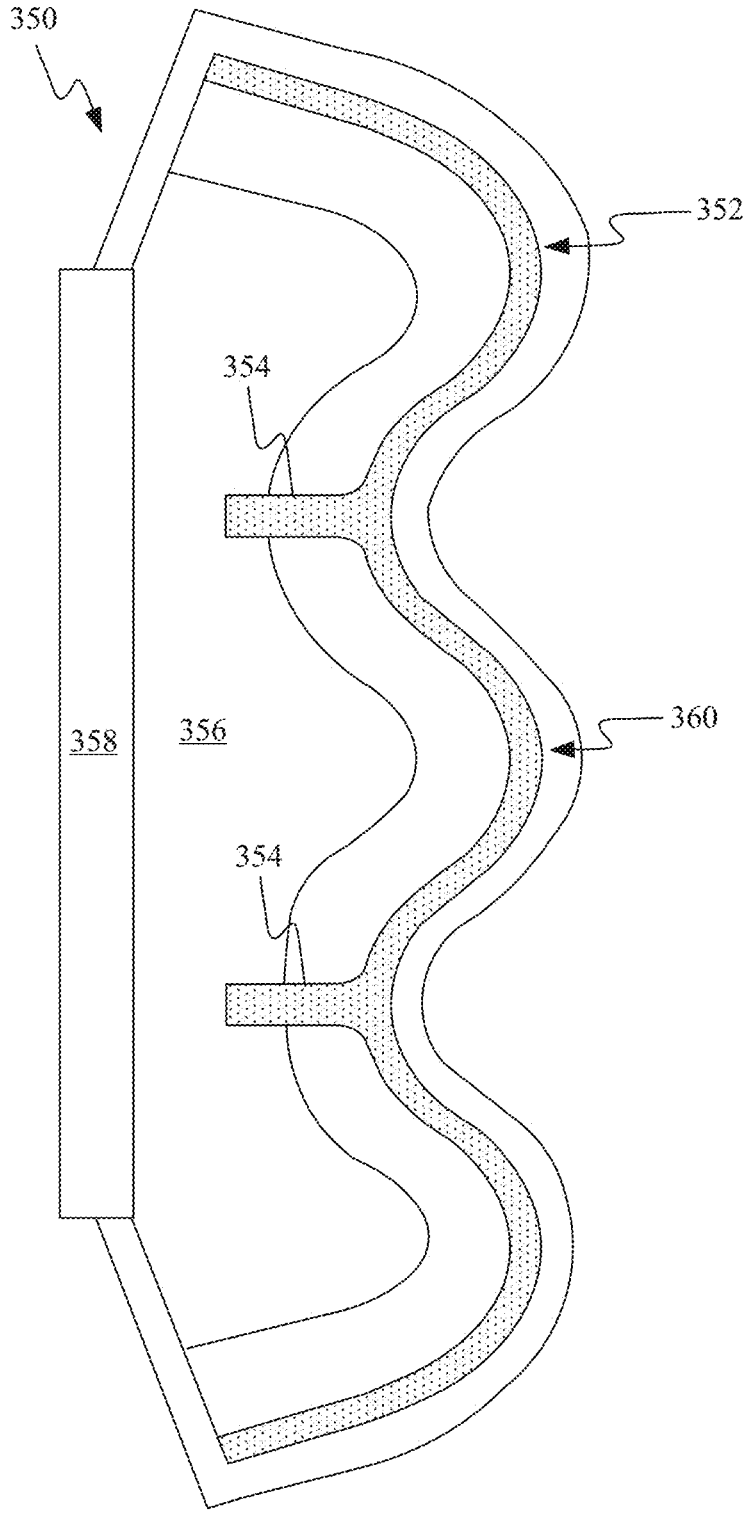
FIG. 3B shows a top-down view of another surf pool and an overall shape of another return channel.

FIG. 3B shows a top-down view of a surf pool 350 and an overall shape of return channel 352. Return channel 352 serves a similar purpose to previously depicted return channel 108 but includes two central channel portions 354 extending into surf basin 356. This configuration can be beneficial in cases where wave generator assembly 358 is configured to send different types of waves to three distinct sections of surf pool 350.

Furthermore, in some embodiments, return channel 352 can be divided into two separate return channels. For example, return channel 352 can be divided into multiple return channels by dividing return channel 352 at point 360, allowing for independent return channels to feed each of central channel portions 356. Any of the surf pools depicted herein could include return channel configurations with multiple return channels arranged to follow the periphery of the surf pool or in other embodiments, discrete rows of return channels could be arranged to help collect water and/or dissipate wave energy.

Figure 4A:
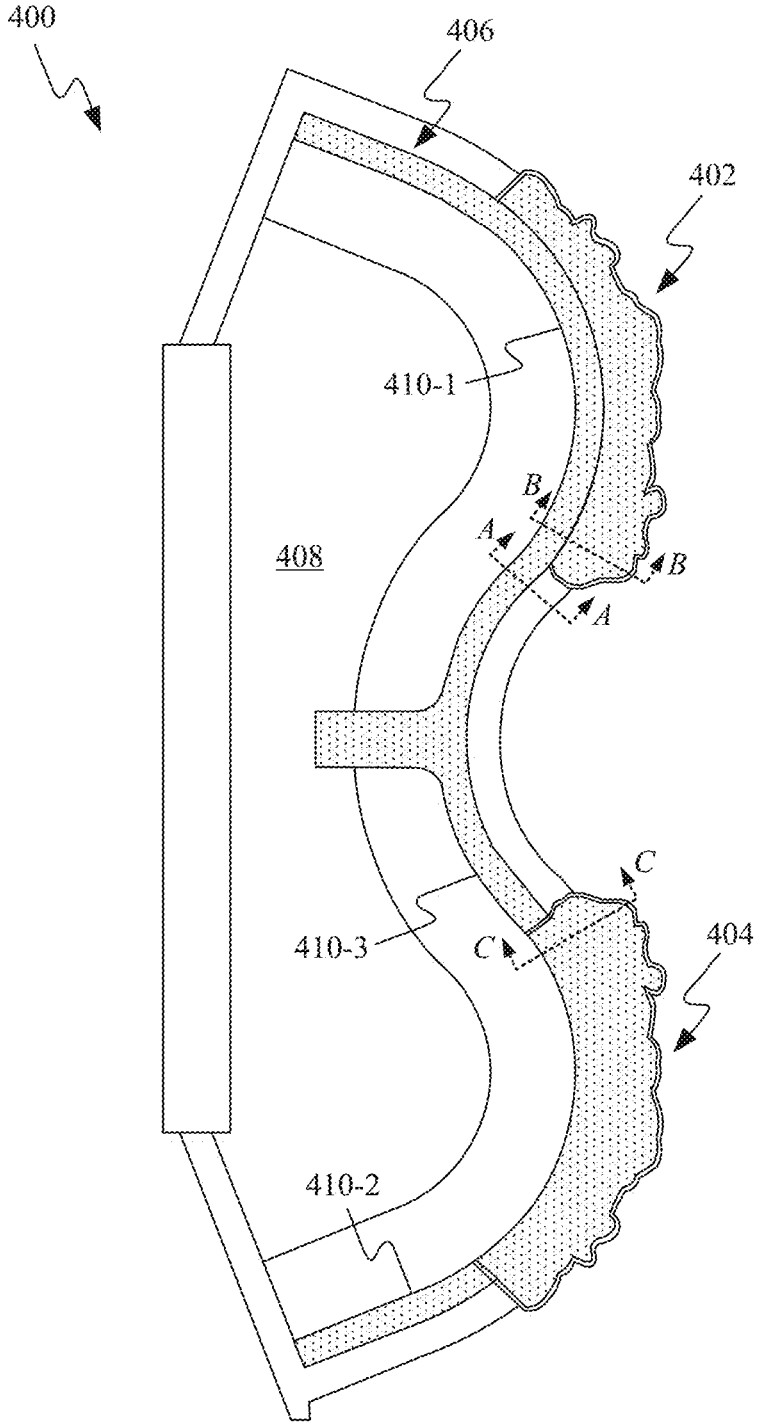
FIG. 4A shows a top-down view of another exemplary surf pool with multiple edge pools arranged in close proximity or integrated with the return channel.

FIG. 4A shows a top-down view of a surf pool 400 similar in operation to surf pool 100 that includes multiple integral edge pools (e.g. first edge pool 402 and second edge pool 404) formed adjacent to or integrated with a return channel 406 configured to redirect water back into surf basin 408. While this particular surf pool 400 includes only two distinct edge pools, it should be appreciated that a surf pool could be configured with a smaller or larger number of edge pools. For example, one, three, four or five edge pools are also possible. Also smaller pools can be formed within the bounds of integral edge pools 402 and/or 404. Edge pool 402 shares a wall with a peripheral channel portion 410-1 of the return channel 406. Edge pool 404 extends into and allows a peripheral barrier associated with a section of peripheral channel portion 410 to be removed so that edge pool 404 can incorporate space otherwise taken by peripheral channel portion 410. The edge pool configurations can be a great choice when more variability is desired within a lounging pool. These configuration allow for some disturbances of the water. For example, some disturbances would result from waves sometimes flowing into and out of edge pool 404. It should be noted that while edge pool 404 is shown with a barrier separating it from adjacent sections of the return channel 406 that the barrier can be entirely removed to allow edge pool 404 to be completely incorporated into the return channel 406

In some embodiments, water within different sections of peripheral channel portion 408 is in fluid communication with and therefore allowed to freely circulate between edge pool 404 and adjacent sections of peripheral channel portion 410. Additionally, edge pool 404 can include a series of valves and/or pumps that help to maintain a desired water level within edge pool 404. The use of pumps and valves can also be operable to help regulate a level of water in the adjacent sections of peripheral channel portion 410. For example, edge pool 404 can act as a pass through that allows water from section 410-2 of peripheral channel portion 410 to move into peripheral channel portion 410-3 in the event water levels in peripheral channel portion 410-2 exceed a predetermined threshold level or in the event of a threshold height differential in the water contained within sections 410-2 and 410-3 of peripheral channel portion 410. Alternatively, a floor of peripheral channel portion 410-2 can be higher than a floor of peripheral channel portion 410-3 and piping can be arranged to transfer water slowly from peripheral channel portion 410-2, through edge pool 404 and to peripheral channel portion 410-3. In some embodiments, this piping can be arranged along the floor or just beneath the floor of edge pool 404.

Figure 4B:
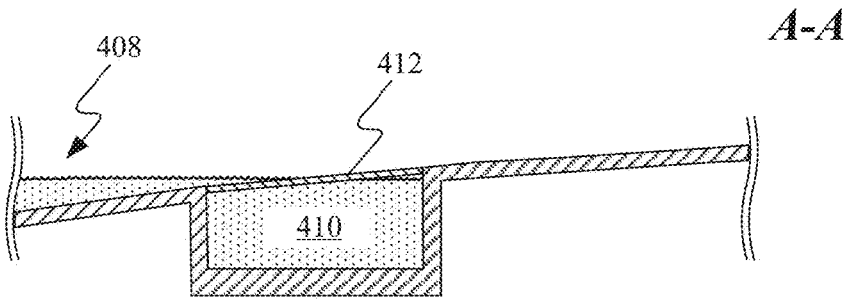
FIG. 4B shows a cross-sectional side view of the surf pool depicted in FIG. 4A in accordance with section line A-A from FIG. 4A.

FIG. 4B shows a cross-sectional side view of surf pool 400 in accordance with section line A-A as shown in FIG. 4A. In particular, FIG. 4B shows a cross-sectional view of peripheral channel portion 410 covered by grating panel 412 and how grating panel accommodates the passage of water into peripheral channel portion 410 while also allowing for convenient movement of a user over peripheral channel portion 410. As depicted, an inclined slope remains substantially similar to the slope of the terrain leading out of surf basin 408, thereby lowering the risk of guests tripping or losing their balance as they cross peripheral channel portion 410. In some embodiments, grating panel 412 can be installed and arranged such that the upward facing surface of the grating panel is substantially flush with an upward facing surface of surf basin 408 and such that the upward facing surface of the grating panel follows an upward slope of the surf basin. While the cross-sectional views show grating panel following a slope of the wave pool, it should be appreciated that in some embodiments a slope of the grating can increase in order to orient the grating more directly at incoming waves and thereby capture more water. It should be noted that the grating panels used to cover the return channel of surf pool 100 can have a similar arrangement to the grating panel 412 as depicted here in FIG. 4B. Moreover, the grating panels are not limited to planar configurations (e.g., horizontally planar). The grating panels can have a contoured upper surface (e.g., slightly concave or convex) as a result of the contouring and shaping of the surf basin 408 of the surf pool at any particular location adjacent the return channel.

Figure 4C:
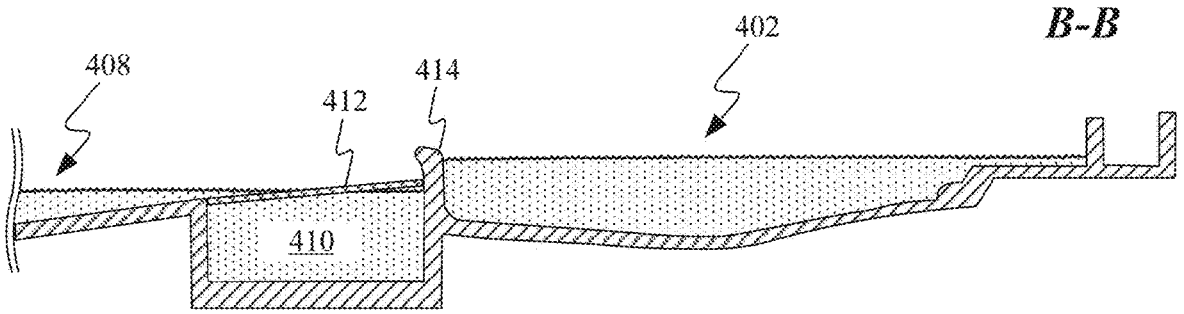
FIG. 4C shows a cross-sectional side view of the surf pool depicted in FIG. 4A in accordance with section line B-B from FIG. 4A.

FIG. 4C shows a cross-sectional side view of surf pool 400 in accordance with section line B-B as shown in FIG. 4A that shows peripheral channel portion 410 and edge pool 402. As depicted, water positioned within edge pool 402 and peripheral channel portion 410 is separated by a common channel wall 414. In some embodiments, a distal end of channel wall 414 can be decorated with rocks or other barriers that help reduce an amount of water splashing into edge pool 402 as a result of waves being generated within surf basin 408. As depicted, the presence of sloped grating panel 412 helps guests to more easily enter and exit edge pool 402 from surf basin 408 by reducing an apparent height of channel wall 414 with a guest standing upon a portion of grating panel 412 proximate channel wall 414.

Figure 4D:
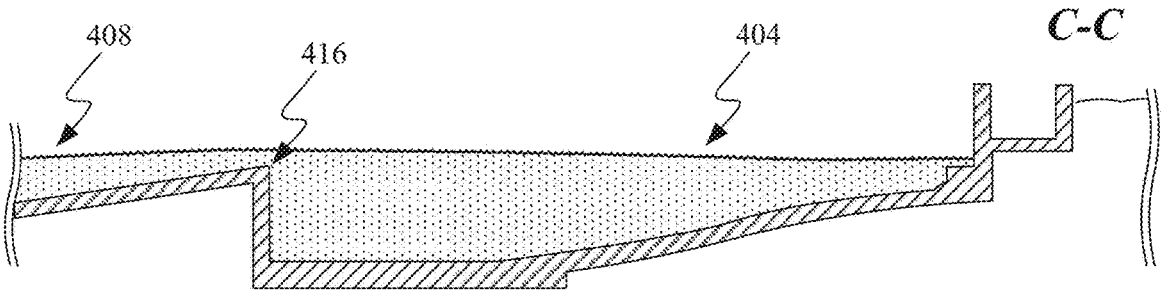
FIG. 4D shows a cross-sectional side view of the surf pool depicted in FIG. 4A in accordance with section line C-C as shown in FIG. 4A.

FIG. 4D shows a cross-sectional side view of surf pool 400 in accordance with section line C-C as shown in FIG. 4A that shows peripheral channel portion 410 and edge pool 404. As depicted water from surf basin 408 is able to splash freely into edge pool 404, which acts as extended storage for return channel 410 by collecting some waves that send water to the periphery of surf pool 400. Between waves water levels can sink just below an outer lip 416 of surf basin 408. As mentioned previously, the illustrated configuration is operable to allow the space generally taken up by peripheral channel portion 410 to contribute to a size of edge pool 404. This configuration also removes the need for an outer channel wall, similar to channel wall 414 shown in FIG. 4C. In some embodiments, edge pool 404 can be open to peripheral channel portion 410. In some embodiments and as depicted in FIG. 4A, edge pool 404 can be walled off from adjacent sections 410-2 and 410-3 of peripheral channel portion 410. Similar to the embodiments described in conjunction with edge pool 402, edge pool 404 can also be configured to allow for the passage of water between sections 410-2 and 410-3 or peripheral channel portion 410 as needed. Walling off edge pool 404 from sections 410-2 and 410-3 can allow for more control over the water levels within edge pool 404. FIG. 4D shows how simple it is for a guest to transition from surf basin 408 to edge pool 404 simply by stepping past the outer lip 416 of surf basin 408.

Figure 5:
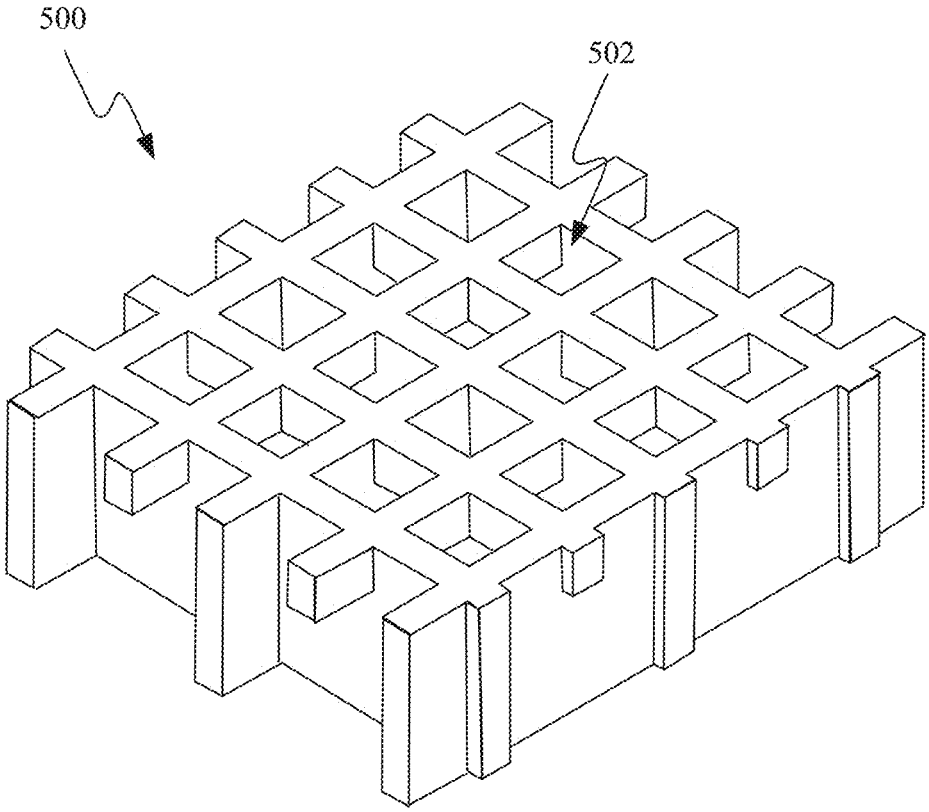
FIG. 5 shows a perspective view of an exemplary section of a grating panel in accordance with the described embodiments.

FIG. 5 shows a perspective view of an exemplary section 500 that can be incorporated into the grating panel 412 as shown in FIGS. 4A-4D. An actual grating panel 412 would be much larger than depicted and in some embodiments have a size of about one meter by four meters. Additionally, the upper surface of the grating panel can be planar as illustrated or have or achieve contouring. The shape in a first plan can be square or rectangular. In some configurations, one or more sides of the grating panel can be curved. Openings 502, can be square, as illustrated, or any other suitable shape including, but not limited to rectangular, triangular, round, oval, and ovoid. In some embodiments, a size of openings 502 can be about 8 mm square in a first dimension. The dimensional size of openings 502 of the grating can be varied for different effects. For example, grating openings 502 having smaller sizes, e.g. between 4 mm and 8 mm can also be used and are considered within the scope of the described embodiments. A thickness of grating panel 412 can vary between 20 and 80 mm in thickness and be formed from a polyester resin in some embodiments.

Figure 6:
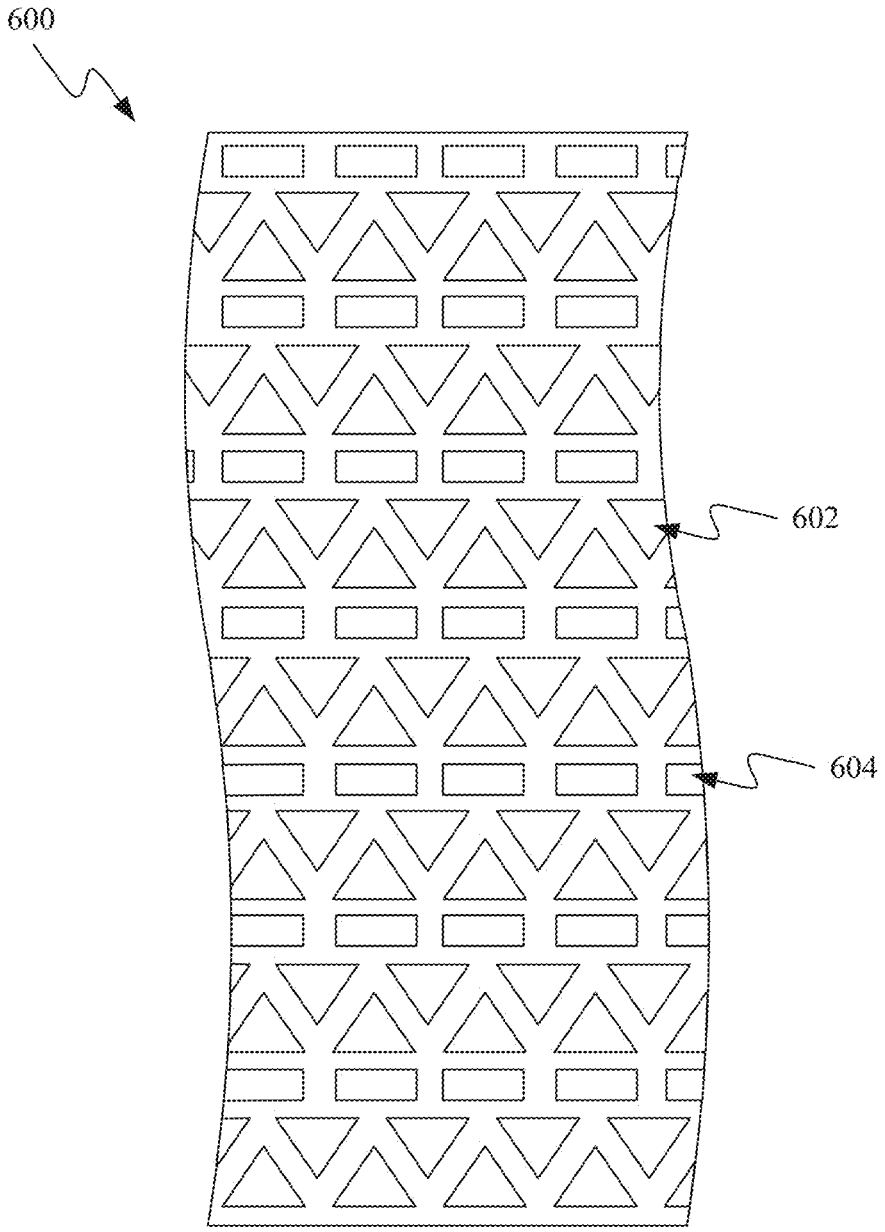
FIG. 6 shows a top-down view of another exemplary section that can be incorporated into the grating panel shown in FIGS. 4A-4D and includes different shaped openings

FIG. 6 shows a top-down view of another exemplary section 600 that can be incorporated into the grating panel 412 as shown in FIGS. 4A-4D and includes different shaped openings. In particular, section 600 includes triangular openings 602 and rectangular openings 604, illustrating how a single section of a grating panel can include multiple differently shaped openings. Grating panels can include openings of different shape and size to fine tune a desired amount of energy dissipation and wave pass through for a particular surf pool configuration.

As described earlier, the interaction between the water driven by wave generator assembly 102 and the grating over central channel portion 110 is effective at dissipating energy from the waves. When water is reentering the surf basin through central channel portion 110, testing showed more than a 60% reduction in velocity for water passing through a grating panel having an 8 mm square grating pattern. Testing also showed the interaction of the waves with the grating having a smoothing effect on the waves. In some embodiments, a slope of the central channel portion of the return channel can vary between about four and six degrees.

Although the subject matter has been described in language specific to structural features and/or methodological acts, it is to be understood that the subject matter configured in the appended claims is not necessarily limited to the specific features or acts described above. Rather, the specific features and acts described above are disclosed as example forms of implementing the claims.

Unless specific arrangements described herein are mutually exclusive with one another, the various implementations described herein can be combined in whole or in part to enhance system functionality and/or to produce complementary functions. Likewise, aspects of the implementations may be implemented in standalone arrangements. Thus, the above description has been given by way of example only and modification in detail may be made within the scope of the present invention.

With respect to the use of substantially any plural or singular terms herein, those having skill in the art can translate from the plural to the singular or from the singular to the plural as is appropriate to the context or application. The various singular/plural permutations may be expressly set forth herein for sake of clarity. A reference to an element in the singular is not intended to mean "one and only one" unless specifically stated, but rather "one or more." Moreover, nothing disclosed herein is intended to be dedicated to the public regardless of whether such disclosure is explicitly recited in the above description.

In general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). Furthermore, in those instances where a convention analogous to "at least one of A, B, and C, etc." is used, in general, such a construction is intended in the sense one having skill in the art would understand the convention (e.g., "a system having at least one of A, B, and C" would include but not be limited to systems that include A alone, B alone. C alone, A and B together. A and C together, B and C together, or A, B, and C together, etc.). Also, a phrase presenting two or more alternative terms, whether in the description, claims, or drawings, should be understood to include one of the terms, either of the terms, or both terms. For example, the phrase "A or B" will be understood to include the possibilities of "A" or "B" or "A and B."

Additionally, the use of the terms "first," "second," "third," etc., are not necessarily used herein to connote a specific order or number of elements. Generally, the terms "first," "second." "third." etc., are used to distinguish between different elements as generic identifiers. Absence a showing that the terms "first," "second," "third," etc., connote a specific order, these terms should not be understood to connote a specific order. Furthermore, absence a showing that the terms first," "second," "third." etc., connote a specific number of elements, these terms should not be understood to connote a specific number of elements.

While preferred embodiments of the present invention have been shown and described herein, it will be obvious to those skilled in the art that such embodiments are provided by way of example only. Numerous variations, changes, and substitutions will now occur to those skilled in the art without departing from the scope of the invention. For example, the use of comprise, or variants such as comprises or comprising, includes a stated integer or group of integers but not the exclusion of any other integer or group of integers. It should be understood that various alternatives to the embodiments of the invention described herein may be employed in practicing the invention. It is intended that any claims presented at any time in this application define the scope of the invention and that methods and structures within the scope of these claims and their equivalents are covered thereby.

What is claimed is:

1. A surf pool, comprising:

a surf basin;

a wave generator disposed on a first side of the surf basin and configured to generate waves that travel from the first side of the surf basin to a second side of the surf basin opposite the first side of the surf basin; and a return channel comprising a peripheral channel portion extending along at least a portion of a periphery of the second side of the surf basin and a central channel portion that is connected to and protrudes from the peripheral channel portion and into a central region of the surf basin, the return channel configured to capture water therein, the central channel portion extending only partially across the surf basin from the second side towards the first side to reintroduce the captured water back into the surf basin at a middle region thereof between the first side and the second side;

wherein movement of the water captured in the peripheral channel portion is limited to movement along the periphery of the surf basin until the water enters the central channel portion at which point the water is able to move directly toward the first side of the surf basin.

2. The surf pool of claim 1, wherein a central channel width of the central channel portion is larger than a peripheral channel width of the peripheral channel portion.

3. The surf pool of claim 1, further comprising a plurality of grating panels covering at least the central channel portion of the return channel such that upward facing surfaces of the plurality of grating panels are flush with and follow an upward slope of the surf basin.

4. The surf pool of claim 3, further comprising a plurality of beams extending across a return channel width of the return channel and supporting the plurality of grating panels.

5. The surf pool of claim 3, further comprising a plurality of concrete piers disposed within the return channel and operable to support the plurality of grating panels.

6. The surf pool of claim 4, wherein the return channel width of the return channel is at least 4 meters.

7. The surf pool of claim 1, further comprising an edge pool, wherein the edge pool shares a wall with the return channel.

8. The surf pool of claim 7, further comprising a plurality of grating panels covering the return channel such that one or more of the plurality of grating panels are in direct contact with the wall shared by the return channel and the edge pool.

9. The surf pool of claim 1, further comprising an edge pool disposed between and separating a first section of the return channel and a second section of the return channel.

10. The surf pool of claim 9, wherein the return channel is configured to transfer water from the first section to the second section by way of the edge pool.

11. The surf pool of claim 9, wherein the edge pool is in fluid communication with the first section and the second section of the return channel.

12. The surf pool of claim 1, wherein the surf basin is defined by a plurality of side walls and a bottom surface and wherein the return channel comprises a channel formed in the bottom surface.

13. The surf pool of claim 1, wherein the central channel portion is a first central channel portion and wherein the return channel further comprises a second central channel portion that is connected to and protrudes from the peripheral channel portion and into the central region of the surf basin.

14. A return channel, the return channel comprising:

a peripheral channel portion extending along at least a periphery of a first side of a surf basin, opposite a second side of the surf basin;

a central channel portion that is connected to and protrudes from the peripheral channel portion and into a central region of the surf basin, the return channel configured to capture water therein, the central channel portion configured to extend only partially across the surf basin from the first side towards the second side to reintroduce the captured water back into the surf basin at a middle region thereof between the first side and the second side; and a plurality of grating panels covering at least a portion of the peripheral channel portion and the central channel portion, wherein movement of water captured in the peripheral channel portion is limited to movement along the periphery of the surf basin until the water enters the central channel portion at which point the water is able to move toward the central region of the surf basin.

15. The return channel of claim 14, wherein upward facing surfaces of the plurality of grating panels are flush with and follow an upward slope of the surf basin.

16. The return channel of claim 14, wherein the central channel portion protrudes from the peripheral channel portion and toward a wave generator located on a second side of the surf basin opposite the first side of the surf basin.

17. The return channel of claim 14, further comprising a plurality of beams extending across a return channel width of the return channel and supporting the plurality of grating panels.

18. The return channel of claim 14, further comprising a plurality of concrete piers disposed within the return channel and operable to support the plurality of grating panels.

19. The return channel of claim 14, further comprising an edge pool, wherein the edge pool shares a wall with the peripheral channel portion of the return channel.

20. The return channel of claim 14, further comprising an edge pool disposed between and separating a first section of the peripheral channel portion and a second section of the peripheral channel portion.

21. The return channel of claim 20, wherein the return channel is configured to transfer water from the first section to the second section by way of the edge pool.

22. The surf pool of claim 8, wherein:

at least one grating panel of the plurality of grating panels comprises a plurality of openings; and the plurality of openings define at least one of:

at least two differing shapes; or at least two differing sizes.

23. The return channel of claim 14, wherein:

at least one grating panel of the plurality of grating panels comprises a plurality of openings; and the plurality of openings define at least one of:

at least two differing shapes; or at least two differing sizes.

* * * * *